US005090597A

United States Patent [19]

Johnson

[11] Patent Number: 5,090,597

[45] Date of Patent: Feb. 25, 1992

[54] MASONRY GROUT BAG

[75] Inventor: Gregory J. Johnson, Mission Viejo, Calif.

[73] Assignee: Westco Plastics, Inc., Laguna Hills, Calif.

[21] Appl. No.: 558,744

[22] Filed: Jul. 26, 1990

[51] Int. Cl.[5] ..... B65D 35/00

[52] U.S. Cl. ..... 222/107; 222/92

[58] Field of Search ..... 222/92, 107

[56] References Cited

U.S. PATENT DOCUMENTS

| | | | |
|---|---|---|---|
| 279,555 | 6/1883 | Fish | 222/107 X |
| 1,309,819 | 7/1919 | Shepard | 222/107 |
| 1,409,544 | 3/1922 | Hallock | 222/107 X |
| 3,152,727 | 10/1964 | Evans | 222/107 |
| 3,157,312 | 11/1964 | Kitterman | 222/107 X |
| 3,200,996 | 8/1965 | Picatti | 222/107 |
| 3,285,202 | 4/1966 | MacManus | 222/107 |
| 3,666,145 | 5/1972 | Fisher | 222/107 |
| 3,782,601 | 1/1974 | Krawagna | 222/107 |
| 4,358,028 | 11/1982 | Chiquiar-Arias | 222/107 |

FOREIGN PATENT DOCUMENTS

| | | | |
|---|---|---|---|
| 825871 | 12/1937 | France | 222/107 |

*Primary Examiner*—Michael S. Huppert
*Assistant Examiner*—Anthoula Pomrening
*Attorney, Agent, or Firm*—Stetina and Brunda

[57] ABSTRACT

A masonry grout bag having an integral semi-rigid tip formed by immersing the tip in a liquid rubber-like coating compound. The liquid rubber-like coatings cure to form a semi-rigid layer upon the internal and external surfaces of the tip. The grout bag is used for applying grout to masonry structures, such as tile floors, during athe installation process.

4 Claims, 2 Drawing Sheets

PRIOR ART

MASONRY GROUT BAG

FIELD OF THE INVENTION

The present invention relates generally to masonry tools and more particularly to a masonry grout bag having an integral semi-rigid tip formed by immersing the tip in a liquid rubber coating compound. The liquid rubber cures to form a semi-rigid layer upon the external surface of the tip. The grout bag is used for applying grout to masonry, such as tile floors, during the installation process.

BACKGROUND OF THE INVENTION

Grout bags for applying grout to floor tiles and the like during their installation are well known. Such grout bags typically comprise a flexible fabric cone having a semi-rigid tip. The cone of contemporary grout bags is typically formed of a vinyl laminated fabric which is formed into a cone and sewn or glued at the seam in the fashion of a cake decorating bag. A semi-rigid insert is glued or sewn into the tip of the cone to provide structural rigidity so that the tip may be forced into the void between adjacent tiles where grout is to be applied. The insert is commonly made of plastic. It may be either preformed in the shape of a cone or formed from flat stock which is rolled into a cone, glued or sewn at the seam, inserted into the grout bag, and glued or sewn in place.

The vinyl layer of the vinyl laminated plastic forms the inside surface of the grout bag, thereby sealing moisture within the bag. The fabric outer layer provides a non-slip grip for the user.

The masonry grout bag is used by filling it, through the upper opening, with grout, grasping the top portion in one hand to seal the upper opening, and squeezing the grout-filled cone with the other hand to force grout from the tip and into the void between adjacent tiles. This is done in much the same manner as applying decorative icing to a cake with a cake decorating bag.

Forming the grout bag of a vinyl coated fabric and a separate tip insert makes the fabrication process comparatively elaborate and expensive. After the cone is formed, then the insert must also be formed if a preformed insert is not used, and then the insert is inserted and secured within the bag. The use of a preformed insert, while saving labor costs, increases the cost of material. A preformed tip is generally dye cast, thus requiring significant tooling and per unit cost.

Alternatively, the flat stock used to form the insert is comparatively inexpensive, but the process is very labor intensive. Flat stock must be cut to the proper pattern, formed into a cone, sewn or glued at the seam in order to retain its shape, and inserted and secured within the grout bag.

A method of forming a masonry grout bag having a semi-rigid tip but not requiring a separate tip insert is desirable. The separate plastic tip insert of prior art grout bags can crack and become brittle after a period of use. This commonly results in the bag becoming useless for its intended function since the tip can no longer be forced into the void between adjacent tiles. Therefore, a new bag must be purchased. Although the need for an improved masonry grout bag has long been recognized, the solution has heretofore never been addressed.

SUMMARY OF THE INVENTION

The present invention specifically addresses and alleviates the above-mentioned deficiencies associated in the prior art. More particularly, the present invention comprises a masonry grout bag having an integral semi-rigid tip formed by immersing the tip in a liquid rubber-like coating compound. The liquid rubber-like coating cures to form a semi-rigid layer upon the external surface of the tip. The grout bag is used for applying grout to masonry, such as tile and brick floors, during the installation process.

The bag is formed by cutting a sheet of vinyl laminated fabric into substantially the shape of a triangle and forming it into a cone as in the prior art.

The integral semi-rigid tip eliminates the requirement for a separate plastic insert which must be formed into the shape of a cone and inserted into the grout bag and then secured therein. The integral semi-rigid tip is incapable of loosening or becoming detached from the bag.

Forming the tip as an integral part of the masonry grout bag reduces both the labor and materials required for fabrication. Therefore, the masonry grout bag of the present invention can be manufactured at a much lower cost than masonry grout bags of the prior art.

These, as well as other advantages, will be more apparent from the following description and drawings. It is understood that changes in the specific structure shown and described may be made within the scope of the claims without departing from the spirit of the invention.

DETAILED DESCRIPTION OF THE PREFERRED EMBODIMENT

Figure 1:
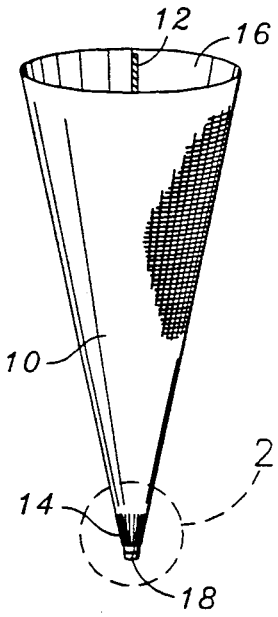
FIG. 1 PRIOR ART
FIG. 1 is a perspective view of a prior art masonry grout bag.
Figure 2:
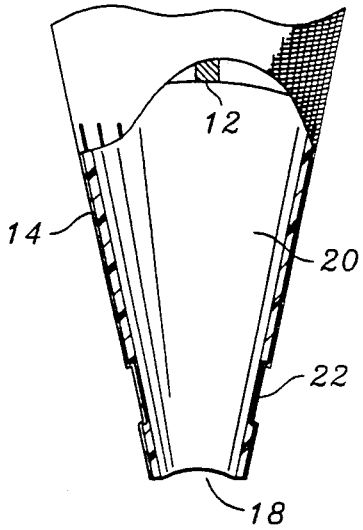
FIG. 2 is an enlarged cross-sectional view of the tip of a prior art masonry grout bag.
Figure 3:
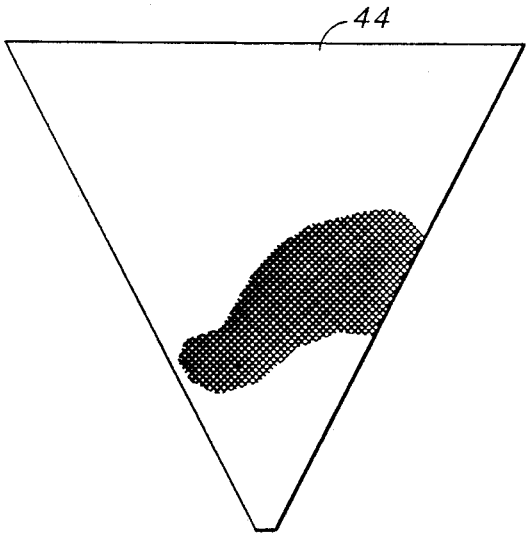
FIG. 3 is a plan view of a sheet of vinyl laminated fabric prior to its being formed into a cone as in the prior art and the present invention.

The masonry grout bag of the present invention is illustrated in FIGS. 3–7 which depict a presently preferred embodiment of the invention and a method for making the same. FIGS. 1 and 2 depict a prior art masonry grout bag.

Referring now to FIGS. 1 and 2, the prior art masonry grout bag comprises a cone 10 and an insert 20. The cone 10 is typically fabricated from vinyl laminated fabric and comprises a tip 14, a first or upper opening 16, and a second or lower opening 18.

The insert 20 is commonly formed of plastic sheet stock which is rolled into a cone and glued together at the seam. It is then inserted into the cone 10, and glued therein. One or more recesses 22 may be formed into the insert 20 to help secure it within the tip 14.

Grout is placed within the masonry grout bag by pouring it in through the first or upper opening 16. The insert 20 causes the tip 14 of the prior art masonry grout bag to be semi-rigid such that the tip 14 can be forced between adjacent tiles and grout can be squeezed through the lower opening 18 of the tip 14 and into the void formed by adjacent tiles and not generally upon the exposed upper surface of the tiles.

Referring now to FIGS. 3-7, the grout bag of the present invention is depicted preferably comprising a sheet of vinyl laminated fabric 44 cut such that it will form a cone when rolled about a mandrel is depicted. The sheet 44 is formed generally in the shape of a triangle having the tip of one corner removed.

Figure 4:
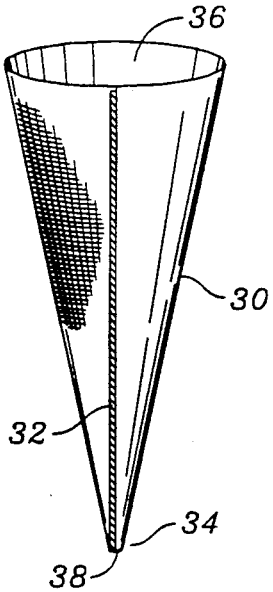
FIG. 4 is a perspective view of the vinyl laminated fabric formed into a cone as in the prior art and the present invention.

FIG. 4 depicts the vinyl laminated fabric sheet 44 after it has been formed into a cone 30. The vinyl laminated fabric sheet 44 may be formed into a cone by wrapping it around a cone-shaped mandrel. The overlapping ends of the sheet 44, which form the seam 32, may be secured together by heat sealing upon a mandrel, the abutting vinyl surfaces of the sheet 44, by gluing with a suitable adhesive or by sewing.

Figure 5:
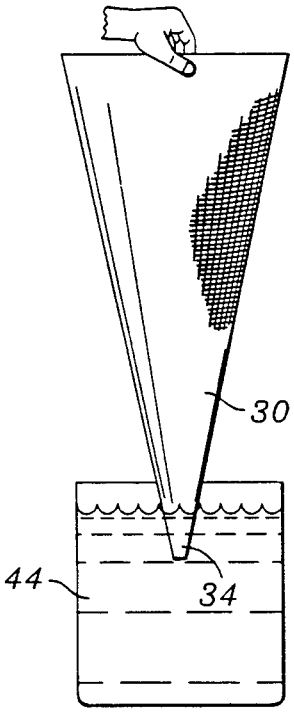
FIG. 5 illustrates the immersion of the tip of the masonry grout bag of the present invention into a liquid coating compound.

Referring now to FIG. 5, the tip 34 of the cone 30 is immersed into a liquid coating compound 44 which, when cured, forms a semi-rigid rubber-like coating upon the inside and outside of the tip 34 of the masonry grout bag. U.S. Pat. No. 4,536,454, issued to Haasl, discloses a suitable coating compound. The Haasl patent utilizes a two-step process wherein a primer coating is first formed upon the material to be coated and then a top coating is applied. Therefore, the use of the method disclosed in the Haasl patent involves immersing the tip 34 of the masonry grout bag into two different coating compounds. However, those skilled in the art will recognize that various single-step coating compounds are available and suitable for use in this invention.

The first or primer-coating of the Haasl process is a thermoplastic resin comprised of methylmethacrylate copolymer, silicon dioxide filler, and a thermoplastic rubber comprising styrene/ethylene/butylene/styrene block copolymer.

The second or top coating is a thermoplastic rubber comprised essentially of a styrene/ethylene/butylene/styrene block copolymer, silicon dioxide filler, and calcium carbonate.

Both coatings are mixed with a solvent, thus keeping them in liquid form. After immersion, the material to be coated is permitted to air dry until the solvent has substantially evaporated.

Figure 6:
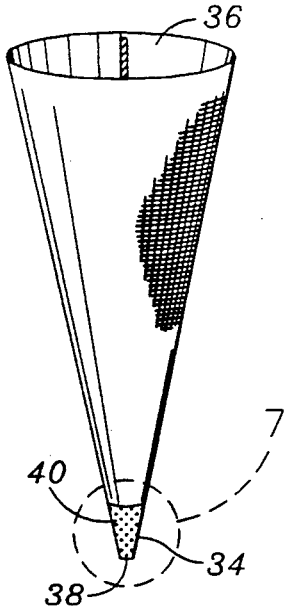
FIG. 6 is a perspective view of the masonry grout bag of the present invention.
Figure 7:
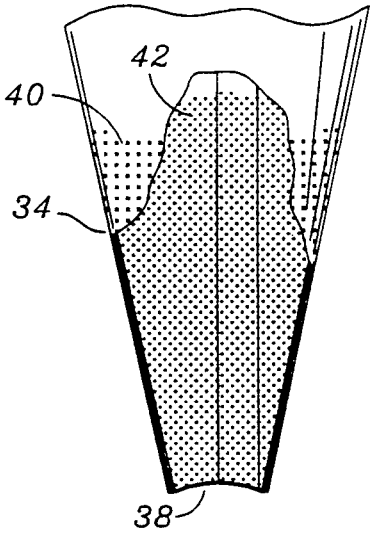
FIG. 7 is an enlarged cross-sectional view of the tip of the masonry grout bag of the present invention.

Referring now to FIGS. 6 and 7, the finished masonry grout bag is depicted. The tip 34 has been coated on both the exterior 40 and interior 42 surfaces. The rubber coating makes the tip 34 semi-rigid, such that it can be forced into the void between adjacent tiles and grout can be forced into the void.

Use of the masonry grout bag of the present invention is the same as in the prior art. However, the masonry grout bag of the present invention will generally last longer since there is no insert to crack or become brittle.

It is understood that the exemplary masonry grout bag described herein and shown in the drawings represents only a presently preferred embodiment of the invention. Indeed, various modifications and additions may be made to such embodiment without departing from the spirit and scope of the invention. For example, the shape of the bag may vary substantially from the cone as disclosed. Also, various materials other than vinyl laminated fabric may be utilized to form the bag. For example, leather, vinyl, and various other flexible plastics may be used. Further, other flexible rubber-like compounds may be utilized on the tip of the bag for rigidifying purposes. Thus, these and other modifications and additions may be obvious to those skilled in the art and may be implemented to adapt the present invention for use in a variety of different applications.

What is claimed is:

1. A masonry grout bag comprising:

(a) a bag formed of a flexible material for holding grout, said bag having first and second openings, the first opening being larger than the second opening; and (b) a semi-rigid tip formed as an integral part of said bag, said tip having an interior surface and an exterior surface and including a coating of semi-rigid material formed on said interior and exterior surfaces so as to be in laminar contact with the flexible material of said bag.

2. The masonry grout bag as recited in claim 1 wherein said flexible bag is substantially in the shape of a cone.

3. The masonry grout bag as recited in claim 2 wherein the coating of semi-rigid material is comprised of a rubber material.

4. The masonry grout bag as recited in claim 3 wherein the bag is comprised of vinyl laminated fabric.

* * * * *